US008967100B2

(12) United States Patent
Otsuji et al.

(10) Patent No.: US 8,967,100 B2
(45) Date of Patent: Mar. 3, 2015

(54) TWO-STROKE INTERNAL COMBUSTION ENGINE

(75) Inventors: Takamasa Otsuji, Tokyo (JP); Buhei Kobayashi, Kanagawa (JP)

(73) Assignee: Yamabiko Corporation, Tokyo (JP)

( * ) Notice: Subject to any disclaimer, the term of this patent is extended or adjusted under 35 U.S.C. 154(b) by 0 days.

(21) Appl. No.: 13/569,239

(22) Filed: Aug. 8, 2012

(65) Prior Publication Data

US 2013/0037011 A1 Feb. 14, 2013

(30) Foreign Application Priority Data

Aug. 10, 2011 (JP) ..... 2011-174936

(51) Int. Cl.

| | |
|---|---|
| ***F02B 25/02*** | (2006.01) |
| ***F02B 33/04*** | (2006.01) |
| *F02F 1/22* | (2006.01) |
| *F02B 63/02* | (2006.01) |

(52) U.S. Cl.

CPC ..... *F02B 33/04* (2013.01); *F02B 25/02* (2013.01); *F02F 1/22* (2013.01); *F02B 63/02* (2013.01)

USPC ..... 123/73 PP; 123/65 P; 123/65 WA; 123/65 VB

(58) Field of Classification Search

CPC ..... F02F 1/22; F02B 25/02

USPC ..... 123/65 P, 65 WA, 73 PP

See application file for complete search history.

(56) References Cited

U.S. PATENT DOCUMENTS

| | | | | |
|---|---|---|---|---|
| 4,287,860 | A * | 9/1981 | Fujikawa et al. | 123/73 PP |
| 4,329,948 | A * | 5/1982 | Fujikawa et al. | 123/73 AA |
| 5,813,373 | A * | 9/1998 | Schlossarczyk et al. | 123/65 P |
| 6,848,398 | B2 | 2/2005 | Schmidt et al. | |
| 7,520,253 | B2 * | 4/2009 | Mochizuka et al. | 123/73 PP |
| 2001/0020454 | A1 * | 9/2001 | Kobayashi | 123/73 A |
| 2003/0116107 | A1 | 6/2003 | Laimbock | |
| 2005/0022757 | A1 | 2/2005 | Yamaguchi et al. | |
| 2011/0146642 | A1 * | 6/2011 | Geyer et al. | 123/73 PP |

FOREIGN PATENT DOCUMENTS

| | | |
|---|---|---|
| JP | 59-170423 | 9/1984 |
| JP | 59-173518 | 10/1984 |
| JP | 60-156933 | 8/1985 |

OTHER PUBLICATIONS

Extended European Search Report issued in corresponding European Patent Application No. 12179132.1 dated Dec. 11, 2013 (4 pages).

* cited by examiner

*Primary Examiner* — Lindsay Low
*Assistant Examiner* — Kevin Lathers
(74) *Attorney, Agent, or Firm* — Kilyk & Bowersox, P.L.L.C.

(57) ABSTRACT

It is intended to effectively prevent blow-by with no need for large changes in typical structures of two-cycle internal combustion engines. A main scavenging passage (24) for supplying air-fuel mixture from a crankcase to a combustion chamber for scavenging purposes has a branch scavenging passage (26) that extends upward aslant toward an intake port (14). The main scavenging passage (24) communicates with a first scavenging port (20) located nearer to an exhaust port (16). The branch scavenging passage (26) communicates with a second scavenging port (22). A mean cross-sectional area of the branch scavenging passage (26) is smaller than that of the main scavenging passage (24). Cross-sectional area of a portion (24*b*) next to an inlet port (24*a*) of the main scavenging passage (24) opening to the crankcase is smaller than the sum of cross-sectional areas of the first and second scavenging ports (20, 22).

16 Claims, 14 Drawing Sheets

TWO-STROKE INTERNAL COMBUSTION ENGINE

CROSS-REFERENCE TO RELATED APPLICATIONS

The present application claims priority from Japanese Patent Application No. 2011-174936, filed Aug. 10, 2011, which is incorporated herein by reference.

BACKGROUND OF THE INVENTION

1. Field of the Invention

The present invention relates in general to a two-stroke internal combustion engine, and more specifically relates to a two-stroke internal combustion engine that is capable of reducing the blow-by of air-fuel mixture.

2. Description of Related Art

Two-stroke internal combustion engines, composed of only a small number of parts, are lightweight and compact. Therefore, they are conveniently used as power sources of chain saws and brush cutters. Two-stroke internal combustion engines, in general, have a structure in which a piston opens and closes exhaust ports of a cylinder in its up-and-down movements in the cylinder. Since such engines are configured to discharge exhaust gas from the combustion chamber while supplying air-fuel mixture into the combustion chamber, they involve the problem that the mixture charged into the combustion chamber and yet unburned is discharged outside. This is the problem so-called "blow-by". The blow-by of air-fuel mixture not only deteriorates the fuel consumption but also invites an increase of unburned component (HC=hydrocarbon) in the exhaust gas.

Japanese Laid-open Patent Publication No. S59-170423 A (No. 170423 of the year 1984) has an object to diminish the "blow-by" of air-fuel mixture, and proposes to provide a plurality of scavenging ports opening into the combustion chamber, thereby introducing air-fuel mixture from some of the scavenging ports remoter from an exhaust port into the combustion chamber and introducing fresh air from the others of the scavenging ports nearer to the exhaust port. According to this proposal, since the fresh air is introduced into the combustion chamber in addition to air-fuel mixture, and works to scavenge the combustion chamber, the blow-by amount of air fuel mixture is reduced. This method of scavenging is called "stratified scavenging".

Japanese Laid-open Patent Publication No. S59-170423 A (No. 170423 of the year 1984) proposes another method of stratified scavenging. The proposal of this publication is explained below in greater detail. An invention disclosed in this publication relies on the theory that, to reduce the blow-by phenomenon in a two-stroke internal combustion engine, new air (air-fuel mixture) introduced into the combustion chamber and the burnt gas remaining in the combustion chamber should preferably be prevented from merging. From this standpoint, this publication proposes the invention related to an engine in which scavenging ports are provided at positions symmetrical of an imaginary line connecting the center of the cylinder bore and the center of the exhaust port. At each side of the imaginary line, the scavenging port is composed of a pair of divisional scavenging ports separated by a partition wall, which regulates the directions of air-fuel mixture flowing out of the individual scavenging ports. The engine further has a cavity acting as a scavenging-airflow attenuator at a location opposite from the exhaust port about the center of the cylinder bore. A first one of each pair of divisional scavenging ports, located closer to the exhaust port is oriented away from the exhaust port, that it, upward. In contrast, a second one of each pair of divisional scavenging ports, located closer to the scavenging-airflow attenuating cavity, is oriented toward that cavity.

According to the invention of the publication No. S59-170423 A, scavenging airflows exit from the right and left second divisional scavenging ports in which the partition walls regulate the flow directions toward the scavenging-airflow attenuating cavity. These scavenging airflows hit each other in the scavenging-airflow attenuating cavity and hit the inner wall of the scavenging-airflow attenuating cavity. Thus, the scavenging airflows are attenuated in flow rate and hence prevented from diffusion toward the exhaust port by the scavenging-airflow attenuating cavity. On the other hand, the scavenging airflows exiting from the first divisional scavenging ports flow toward the top of the cylinder while striking one another and expelling the burnt gas into the exhaust port. In this manner, it is possible to make a layered distribution of gases for stratified scavenging, in which the scavenging gas, which is an air-fuel mixture introduced into the combustion chamber through the first and second divisional scavenging ports, distributes in a space in the cylinder apart from the exhaust port, which is a region in the combustion chamber apart from the exhaust port. On the other hand, the burnt gas distributes in a region next to the exhaust port.

Japanese Laid-open Patent Publication No. S60-156933 (No. 156933 of the year 1985) focuses attention to the role of the scavenging passage, which makes communication between the scavenging port opening to the combustion chamber and the crankcase, in a two-stroke internal combustion engine, and proposes an improvement to solve the blow-by problem mentioned above. More specifically, this publication proposes to provide main scavenging passages and sub scavenging passages separated from main scavenging passages by partition walls respectively. The main scavenging passages are continuous from first scavenging ports and the sub scavenging ports are continuous from second scavenging ports. Thus, this proposal uses second scavenging airflows of a higher velocity from the second scavenging ports to control first scavenging airflows from the first scavenging ports. In short, the publication No. S60-156933 proposes to control the flow directions of the first scavenging airflows by using the second scavenging airflows flowing from the second scavenging ports at a higher velocity. Thus, it discloses an embodiment, as a typical example, in which the second scavenging airflows prevent that the first scavenging airflows partly flow into the exhaust port by circulatory shunt.

U.S. Pat. No. 6,848,398 aims higher output power and lower emission, and proposes to regulate angles of sidewalls of a scavenging port approximately rectangular in cross section in a two-stroke internal combustion engine.

The Inventors made researches on the blow-by phenomenon relative to locations of scavenging ports opening to the combustion chamber. FIG. 10 schematically illustrates a typical one of known two-stroke internal combustion engines. Reference numeral 1 in FIG. 1 indicates an exhaust port. A pair of first and second scavenging ports 2 and 3 are provided, respectively, on the right and left symmetrical positions of an imaginary line CL that connects the center O of cylinder bore and the widthwise center of the exhaust port 1. These first and second scavenging ports 2 and 3 are oriented away from the exhaust port. This engine with multiple scavenging ports is a so-called four-flow scavenging engine having four scavenging ports 2, 2, 3, 3 in total.

FIG. 11 illustrates a three-dimensional aspect of the first and second scavenging passages 4 and 5, which extend longitudinally (in parallel to the axial line of the cylinder bore)

from the crankcase to the combustion chamber, and the first and second scavenging ports 2, 3, which are upper ends of the first and second scavenging passages 4, 5. As understood from FIG. 11, in the conventional two-stroke internal combustion engine of the multi-scavenging-port type, each scavenging port (2, 3) is associated with a scavenging passage of its own, and each scavenging passage is substan3tially independent from each other. FIG. 12 shows a layout of the exhaust port 1, intake port 8, first and second scavenging passages 4 and 5 relative to the cylindrically shaped cylinder bore 7.

FIGS. 13 and 14 are diagrams similar to FIG. 10, in which FIG. 13 shows a version with the first and second scavenging ports 2 and 3 being remoter from the exhaust port 1, and FIG. 14 shows a version with the first and second scavenging ports 2 and 3 being closer to the exhaust port 1. In both figures, arrows indicate directions of scavenging airflows.

In the layout of FIG. 13 with the scavenging ports 2 and 3 being remoter from the exhaust port 1, gas exchange is difficult to take place in the in-cylinder region DS between the first scavenging port 2 and the exhaust port 1. In the layout of FIG. 14, in contrast, with the scavenging ports 2 and 3 being nearer to the exhaust port 1, the scavenging airflows supplied from the first scavenging ports 2 are partly liable to shunt and escape through the exhaust port 1 in the former half of each exhaust stroke of the engine.

It is therefore an object of the present invention to provide a two-stroke internal combustion engine capable of effectively preventing the blow-by phenomenon without the need for significant modifications in its typical structure.

SUMMARY OF THE INVENTION

According to the present invention, there is provided a two-stroke internal combustion engine configured to expel burnt gas externally of a combustion chamber through an exhaust port while introducing air-fuel mixture into the combustion chamber from a crankcase through scavenging passages, comprising:

first scavenging ports opening to said combustion chamber and oriented away from said exhaust port;

main scavenging passages making communication between each said first scavenging port and said crankcase;

second scavenging ports opening to said combustion chamber at positions remoter from said exhaust port than said first scavenging ports respectively, and oriented away from said exhaust port; and branch scavenging passages branched from said main scavenging passages and extending aslant away from said exhaust port up to each said second scavenging port, wherein said branch scavenging passages have a mean cross-sectional area smaller than a mean cross-sectional area of said main scavenging passages, and wherein each said first scavenging port and each said second scavenging port have opening areas which are in total larger than a cross-sectional area of each said main scavenging passage at an inlet portion thereof next to said crankcase.

With this structure of the invention, since the scavenging passages open at the ports to the combustion chamber with a wider area than that at the port to the crankcase, scavenging airflows entering into the combustion chamber from the scavenging ports have a lower flow velocity than in conventional engines. Additionally, since the branch scavenging passage is thinner than the main scavenging passage, velocity of a second scavenging airflow from the second scavenging port in communication with the branch scavenging passage is higher than the velocity of a first scavenging air flow from the second scavenging port. Furthermore, the branch scavenging passage extending aslant contributes to improving directivity of the second scavenging airflow from the second scavenging port.

Because of the above-mentioned mechanism, the first scavenging airflow from the first scavenging port closer to the exhaust port is drawn toward the second scavenging airflow from the second scavenging port remoter from the exhaust port. This contributes to reducing the short-cut phenomenon that part of the first scavenging airflow escapes from the exhaust port to the exterior in an initial stage of each exhaust stroke. Further, because the flow velocity of the first and second scavenging airflows ejected from the first and second scavenging ports is relatively slow, and because the first scavenging airflow ejected from the first scavenging port is drawn away from the exhaust port by the second scavenging airflow flowing relatively faster from the second scavenging port, the first scavenging airflow from the first scavenging port moves away from the exhaust port, next hits the inner wall of the cylinder bore, and thereby changes its flow direction toward the exhaust port. Therefore, the traveling distance of the first scavenging airflow from the first scavenging port up to the exhaust port is elongated. This contributes to preventing the blow-by, which will otherwise occur in a later half of each exhaust stroke (see FIG. 2 referred to in later explanation).

Intended effect of preventing the blow-by by the present invention in first and second halves of each exhaust stroke can be attained by simply modifying a conventional engine typically of a four-flow scavenging type. Of course, the second scavenging airflow to be supplied from the second scavenging port may be either air-fuel mixture from the crankcase or fresh air, which may be supplied through the branch scavenging passage.

Other objects and features of this invention will become apparent from detailed explanation of preferred embodiments, which follow.

DETAILED DESCRIPTION OF EMBODIMENTS

Some embodiments of the invention is explained below with reference to the drawings.

Figure 1:
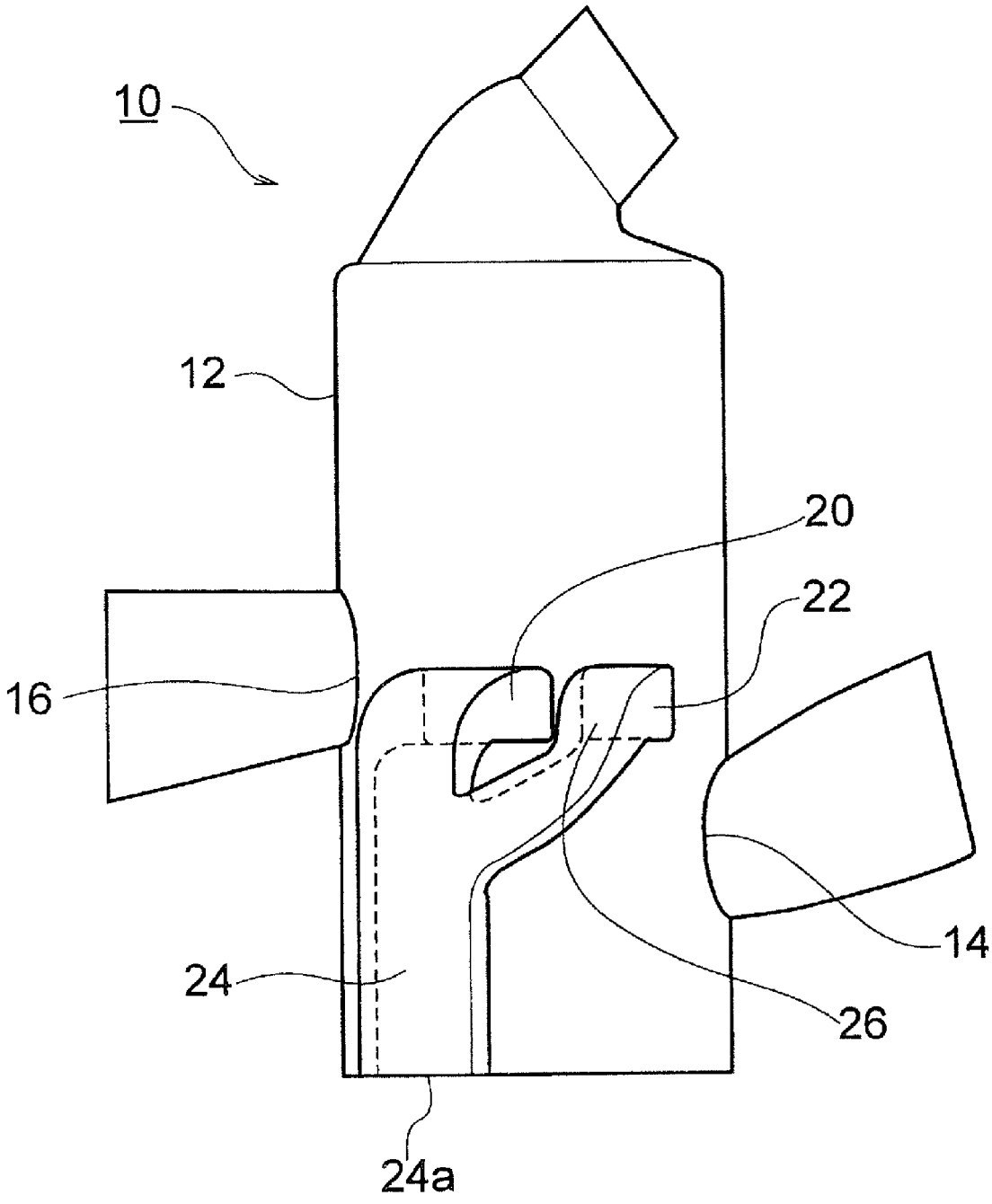
FIG. 1 is a diagram showing a cylinder bore of an engine taken as an embodiment, in which an exhaust port, intake port and multi-scavenging ports opening to the cylinder bore are shown as well to explain scavenging passages continuous to the multi-scavenging ports.
Figure 2:
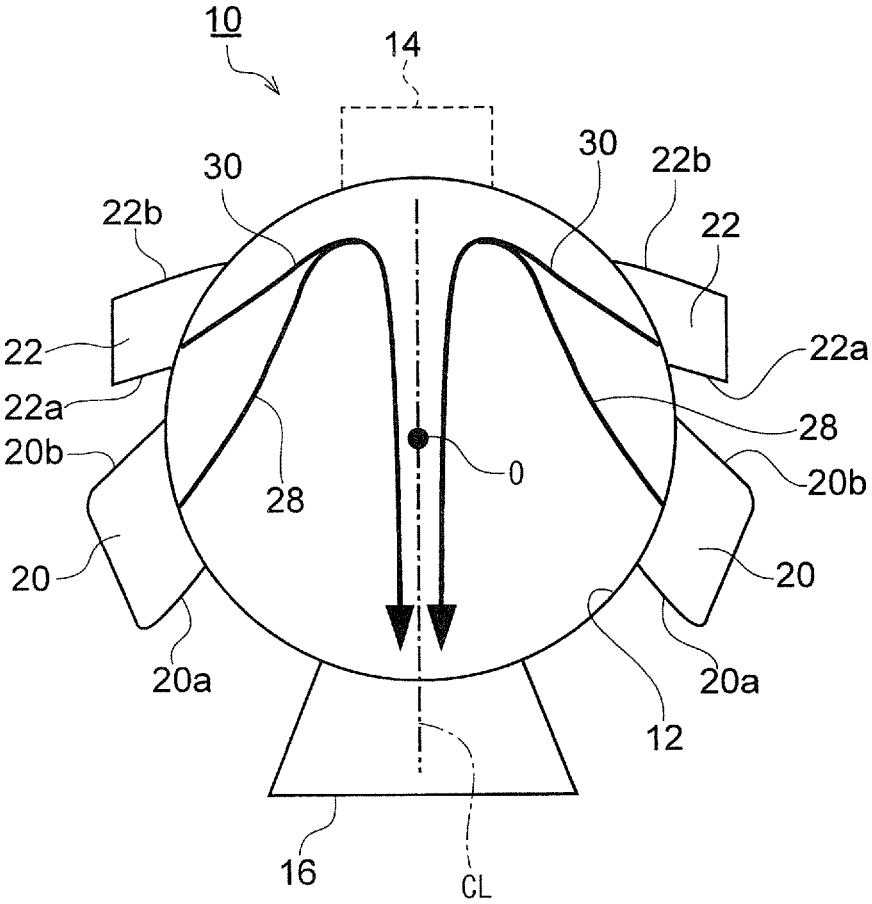
FIG. 2 is a diagram for explaining functions of a scavenging system provided in the embodiment of FIG. 1.
Figure 3:
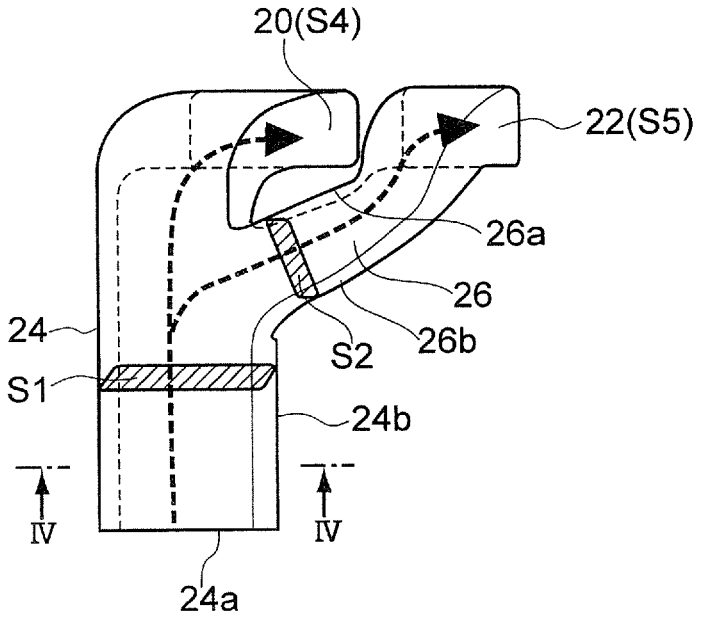
FIG. 3 is a diagram three-dimensionally showing scavenging passages and scavenging ports of the scavenging system provided in the embodiment of FIG. 1

FIGS. 1 through 3 show an embodiment of the invention. As shown in FIG. 1, an air-cooled single-cylinder two-stroke internal combustion engine 10 has a cylinder bore 12 that may be, for example, an aluminum die cast product. An intake port 14 and an exhaust port 16 are formed at diametrically opposite positions of the cylinder bore 12. Air-fuel mixture introduced from the intake port 14 is charged in the crankcase (not shown).

With reference to FIG. 2, a pair of the first and second scavenging ports 20 and 22 is provided at each of axisymmetric positions about an imaginary line CL that connects the center of the cylinder bore O and the center of the exhaust port 16. The first and second scavenging ports 20 and 22 are opened and closed by strokes of piston (not shown). These features of the two-stroke internal combustion engine 10 according to the embodiment of the invention so far depicted are identical to those of conventional engines of the four-flow scavenging type.

With reference to FIG. 3 that illustrates a scavenging system provided in the embodiment, the first scavenging ports 20 closer to the exhaust port 16 are communicated with the crankcase (not shown) by main scavenging passages 24 formed in the cylinder block (not shown) to extend longitudinally. The first scavenging ports 20 are oriented away from the exhaust port 20 as in the conventional engines.

Still referring to FIG. 3, the two-stroke internal combustion engine 10 has branch scavenging passages 26 branched from the main scavenging passages 24 and extending aslant toward the intake port 14. Each branch scavenging passage 26 has an upper wall 26*a* and a lower wall 26*b* both extending aslant from the main scavenging passage 24 toward the intake port 14 approximately in parallel to each other. The branch scavenging passages 26 may have any cross-sectional geometry like the main scavenging passage 24 above. Each branch scavenging passage 26 is smoothly continuous at its top end to the second scavenging port 22, which opens to the combustion chamber just like the first scavenging port 20. Like in conventional engines, the second scavenging port 22 is oriented away from the exhaust port 16.

Let each main scavenging passage 24 have a mean cross-sectional area S1 (FIG. 3) in its entire length from its inlet port 24*a* opening to the crankcase up to the first scavenging port 20 opening to the combustion chamber, and let the branch scavenging passage 26 have a mean cross-sectional area S2 (FIG. 3) in its entire length from the branched point up to the second scavenging port 22 opening to the combustion chamber. When these mean cross-sectional areas S1 an S2 are compared, the mean cross-sectional area S2 of the branch scavenging passage 26 is smaller than the mean cross-sectional area S1 of the main scavenging passage 24. More specifically, the mean cross-sectional area S2 of the branch scavenging passage 26 is approximately 0.56 to 0.75 times the mean cross-sectional area S1 of the main scavenging passage 24. More preferably, minimum cross-sectional area of the branch scavenging passage 26 is about 0.29 to 0.38 times a minimum cross-sectional area of the main scavenging passage 24. That is, the branch scavenging passage 24 defines a thinner passage than the main scavenging passage 26.

In the engine 10 having the above-explained structural features of the scavenging passages, like in conventional engines, the piston (not shown), in its strokes, opens and closes the exhaust port 16, first and second scavenging ports 20, 22, thereby charging air-fuel mixture into the combustion chamber from the crankcase and scavenging the combustion chamber with the air-fuel mixture introduced therein. In the engine 10 according to the embodiment, however, the inlet 24*a* (FIG. 3) of the main scavenging passage 24 opening to the crankcase not only acts as the port for introducing air-fuel mixture from the crankcase to generate the first scavenging airflow to be supplied to the combustion chamber from the first scavenging port 20, but also acts as a port for introducing air-fuel mixture from the crankcase to generate the second scavenging airflow to be supplied to the combustion chamber from the second scavenging port 22. That is, in the scavenging system of the engine 10 according to the embodiment, as shown in FIG. 3, air-fuel mixture in the crankcase enters into the main scavenging passage 24 from its inlet port 24*a* at the crankcase, and the air-fuel mixture is distributed to the branch scavenging passage 26 on the way to the first scavenging port 20 via the main scavenging passage 24.

Figure 4:
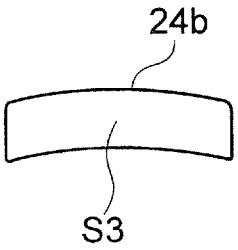
FIG. 4 is a diagram for explaining a cross-sectional area of a main scavenging passage at a port opening to a crankcase.

Therefore, in the scavenging system according to the embodiment, the total opening area (S4+S5 in FIG. 3) of the multiple scavenging ports opening to the combustion chamber, i.e., the first scavenging port 20 and the second scavenging port 22, is larger than the cross-sectional area S3 of the passage at the cross section (FIG. 4) of the common inlet passage portion 24*b* opening to the crankcase. More specifically, in the embodiment, the total opening area (S4+S5) of the first scavenging port 20 and the second scavenging port 22 is approximately 1.2 to 1.4 times the cross-sectional area S3 of the passage at the inlet portion 24*b*. As a result, velocities of the first and second airflows 28 and 30 (FIG. 2) from the first and second scavenging ports 20 and 22 are lower than those in conventional engines.

In addition, the branch scavenging passage 26 continuous to the second scavenging port 22 closer to the intake port 14 extends upward aslant from the main scavenging passage 24 closer to the exhaust port 16 toward the intake port 14 as already explained. Since this extending direction of the branch scavenging passage 26 is common to the orientation of the second scavenging port 22, the branch scavenging passage 26 enhances directional control of the second scavenging airflow 30 from each second scavenging port 22.

As a result of the enhanced directional control of the second scavenging airflows 30 from the second scavenging ports 22, the first scavenging airflows 28 from the first scavenging ports 20 nearer to the exhaust port 16 are drawn toward or into the second scavenging airflows 30. Because of these motions, it is possible to diminish the short-cut phenomenon that the first scavenging airflows 28 partly flow out to the exterior from the exhaust port in an initial stage of each exhaust stroke.

Further, the flow speed of the first and second scavenging airflows 28 and 30 supplied from the first and second scavenging ports 20 and 22 into the combustion chamber is relatively slow because their total opening area of the first and second scavenging ports 20 and 22 is larger than the cross-sectional area of the common passage portions 24*a*. Moreover, as the first scavenging airflows 28 from the first scavenging ports 20 nearer to the exhaust port 16 continuous to the main scavenging passage 24 are drawn toward the intake port 14 by the second scavenging airflows 30 from the second scavenging ports 22, the first scavenging airflows 28 flowing from the first scavenging ports 22 at a relatively slow speed shift toward the intake port 14 and next change their flow directions by bouncing at the inner wall of the cylinder bore 12. This results in substantially elongating the travel distances of the first scavenging airflows 28 up the exhaust port 16. The relatively low flow speed of the first and second scavenging airflows 28, 30 and the elongation of the traveling distances of the first scavenging airflows 28 contribute to prevention of the blow-by in the latter half of each exhaust stroke.

To evaluate the effect of the invention, the Inventors prepared a prototype engine and compared it with existing engines. The Inventors could confirm approximately 1.3% to 3.3% increase of the and approximately 30% reduction of HC by the present invention.

An engine taken as the embodiment has been explained heretofore. The engine, however, can be modified in various respects. For example, regarding the first and second scavenging ports 20, 22, So far explained has been the embodied example of the subject invention. As for the first and second scavenging ports 20 and 22, angles of the sidewalls 20*a*, 20*b* (FIG. 2) of the first and second scavenging ports 20, 22, which are crossing angles of the sidewalls 20*a*, 20*b* of each first scavenging port 20 and/or crossing angles of the sidewalls 22*a*, 22*b* of each second scavenging port 22 relative to the imaginary line CL (FIG. 2) connecting the center O of the cylinder bore 12 and the center of the exhaust port 16, may be regulated as taught by U.S. Pat. No. 6,848,398. Regarding the crossing angles, detailed teaching of U.S. Pat. No. 6,848,398 is incorporated herein, and the present specification omits its explanation.

The explanation of the embodiment was made above by taking the example in which the main scavenging passages 24 and the branch scavenging passages 26 are integrally formed in the cylinder block. However, these passages 24 and/or 26 may be defined by using elements separate prepared from the cylinder block. For example, removable passage-forming member may be fixed to the cylinder block to define the main scavenging passages 24 and the branch scavenging passages 26. It is also possible to pipe members removably connected to the cylinder block to define the main scavenging passages 24 and the branch scavenging passages 26.

Figure 5:
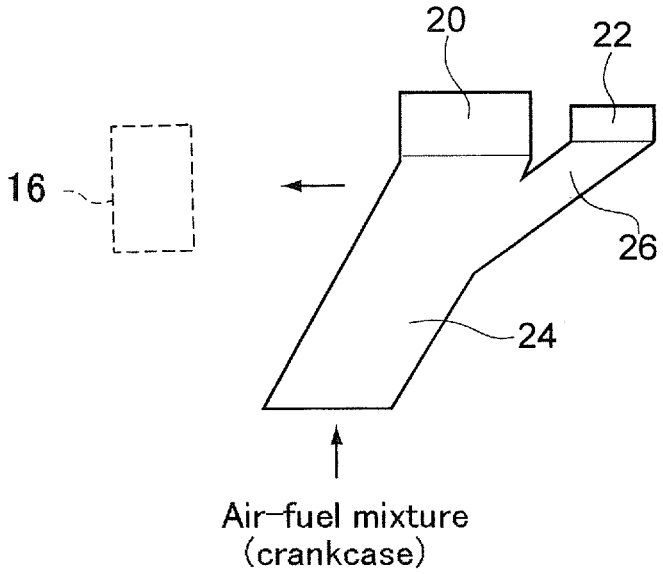
FIG. 5 is a diagram for explaining scavenging passages in a first modification of the embodiment of FIG. 1.
Figure 6:
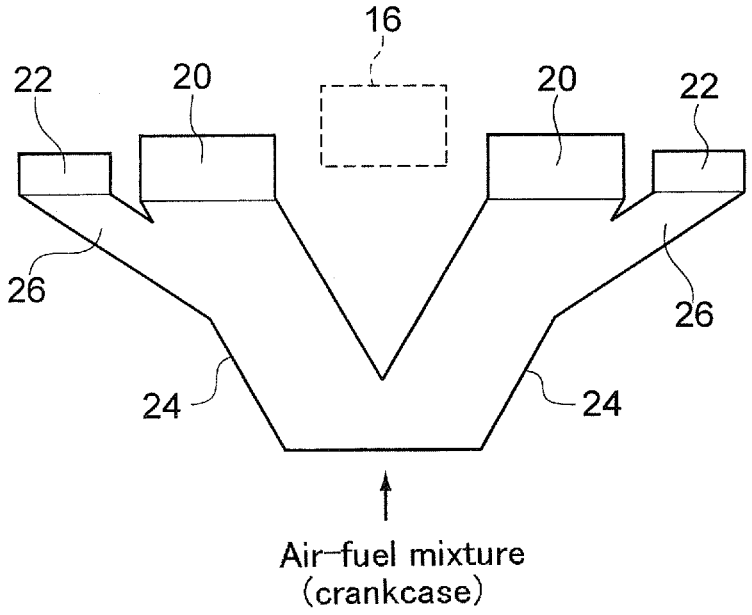
FIG. 6 is a diagram for explaining scavenging passages in a second modification of the embodiment of FIG. 1.

FIGS. 5 to 9 are diagrams for explaining some modified structures. FIG. 5 illustrates a version in which the lower end of each main scavenging passage 24 is offset toward the exhaust port 16 to incline the main scavenging passage 24. FIG. 6 illustrates a version in which the main scavenging passage inclines more largely to a degree where the lower end thereof vertically aligns with the exhaust port 16.

Figure 7:
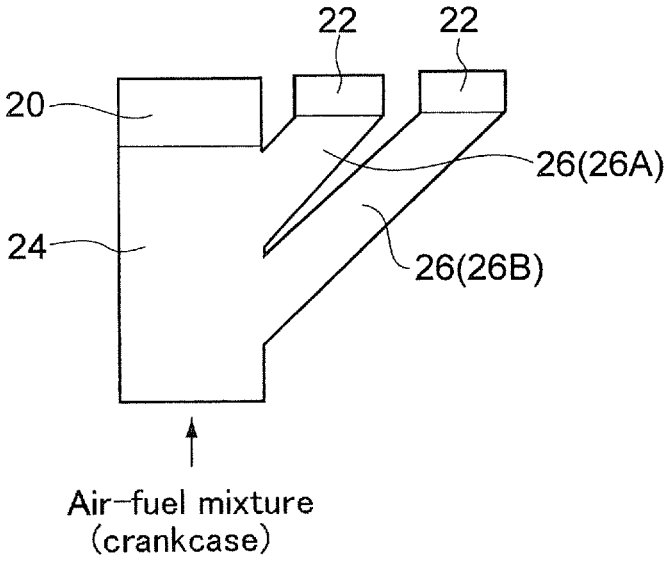
FIG. 7 is a diagram for explaining scavenging passages in a third modification of the embodiment of FIG. 1.

FIG. 7 depicts a structure in which multiple branch scavenging passages (26A, 26B) are provided to branch from each main scavenging passage 24 such that they communicate with the main scavenging passage 24 at its vertically distant positions. Although the main scavenging passage 24 is shown to extend upright in FIG. 7, it may be inclined as shown in FIGS. 5 and 6.

Figure 8:
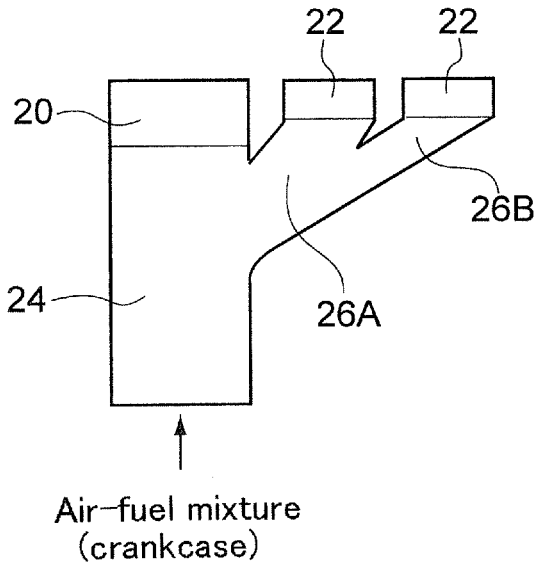
FIG. 8 is a diagram for explaining scavenging passages in a fourth modification of the embodiment of FIG. 1.

FIG. 8 shows a version in which multiple branch scavenging passages 26 (26A, 26B) branch from each main scavenging passage 24 like in the version of FIG. 7. FIG. 8, however, depicts that a single branch scavenging passage 26A may branch directly from, and communicate with, the main scavenging passage 24, and the single branch scavenging passage 26A may divide into multiple branches to form the other branch scavenging passage(s) 26B.

Figure 9:
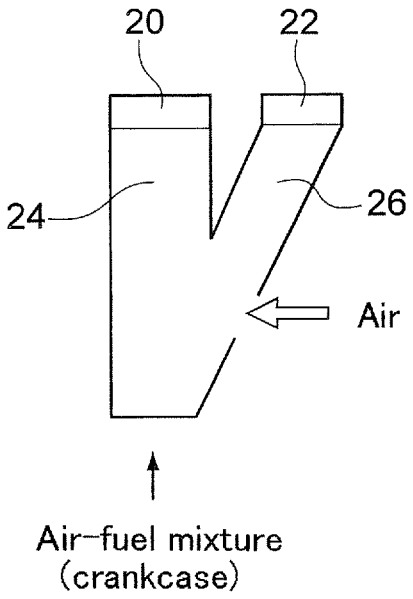
FIG. 9 is a diagram for explaining scavenging passages in a fifth modification of the embodiment of FIG. 1.
Figure 10:
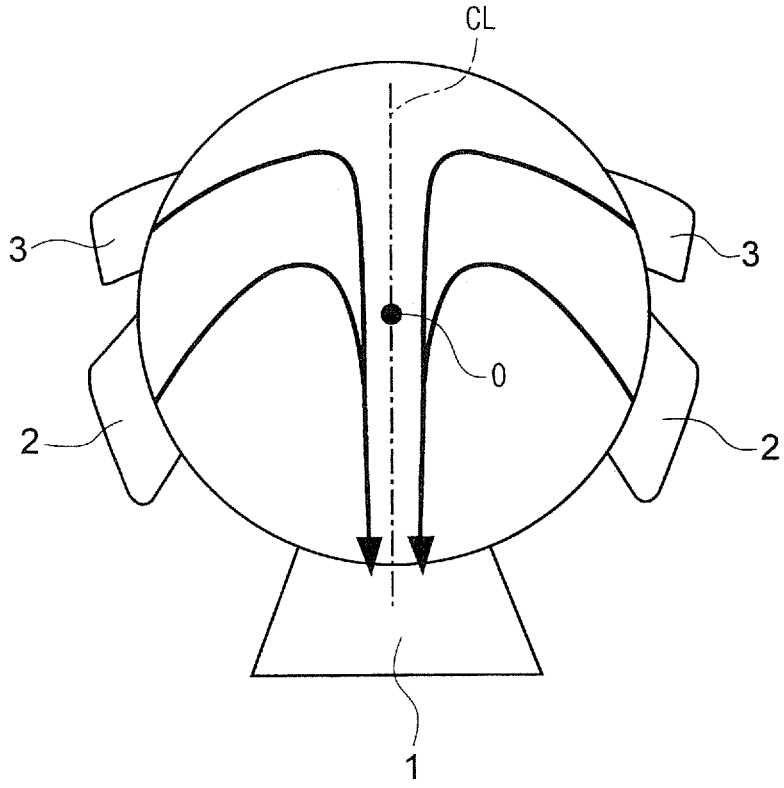
FIG. 10 is diagram for explaining a scavenging system used in a conventional two-stroke engine.
Figure 11:
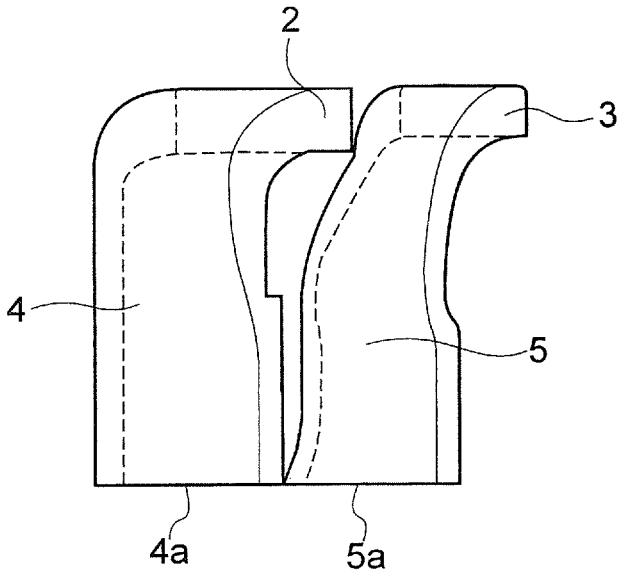
FIG. 11 is a diagram three-dimensionally showing scavenging passages and scavenging ports continuous from the scavenging passages and opening to the combustion chamber in a conventional two-stroke engine.
Figure 12:
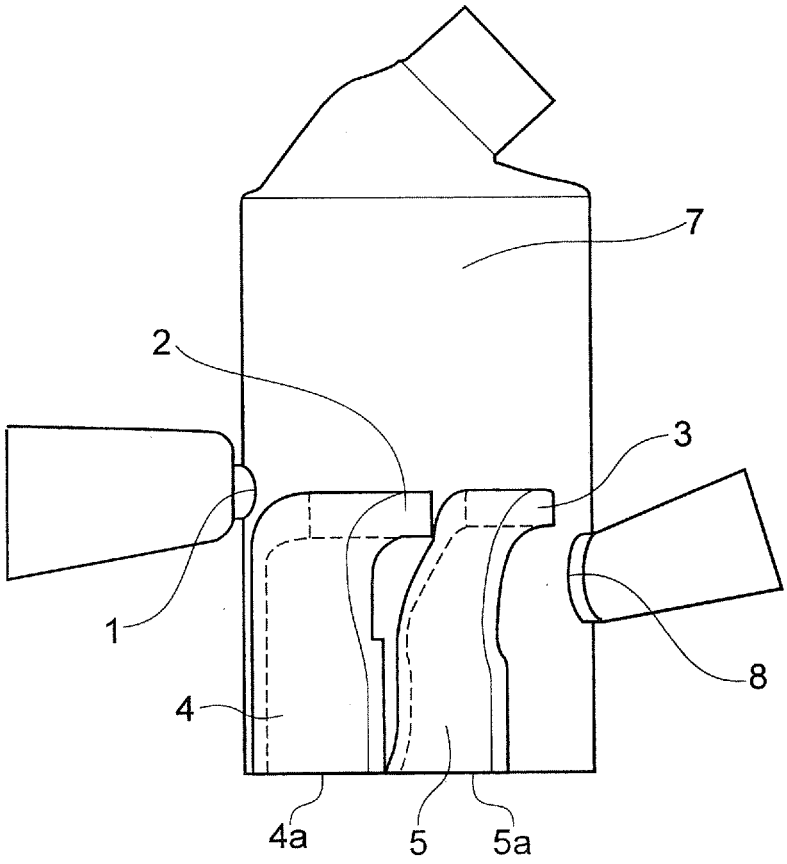
FIG. 12 is a diagram showing a cylinder bore of a conventional two-stroke engine, in which an exhaust port, intake port and multi-scavenging ports opening to the cylinder bore are shown as well to explain scavenging passages continuous to the multi-scavenging ports.
Figure 13:
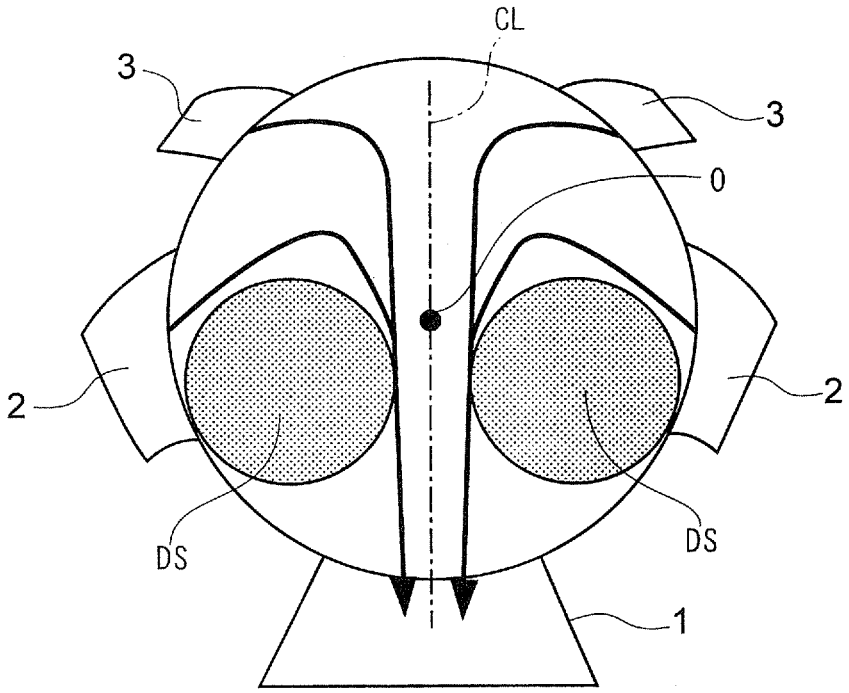
FIG. 13 is a diagram for explaining problems with positioning scavenging ports in a conventional two-stroke engine close to the intake port.
Figure 14:
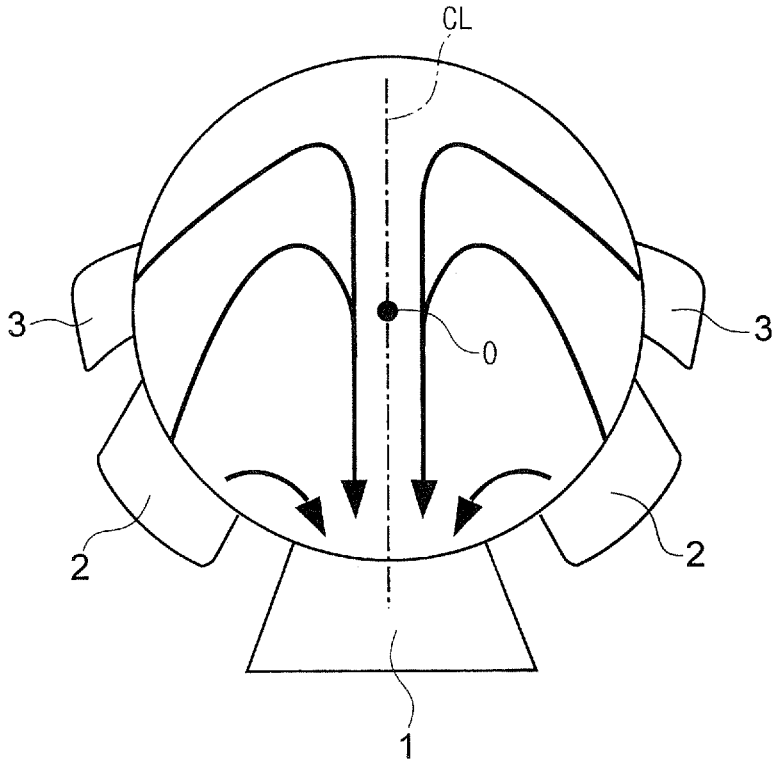
FIG. 14 is a diagram for explaining problems with positioning multi-scavenging ports in a conventional two-stroke engine close to the exhaust port.

FIG. 9 schematically shows an example of scavenging by fresh air. This is illustrates as scavenging the combustion chamber by supplying fresh air to the branch scavenging passage 26 and introducing it into the combustion chamber through the branch scavenging passage 26. Regarding the supply of fresh air, this example may be modified to supply fresh air to the main scavenging passage 24 and introducing it into the combustion chamber from the first scavenging port 20, or from both the first and second scavenging ports 20, 22.

In the embodiment and modified examples explained above, it is effective to determine slanting angles (elevation angles) of the first scavenging ports 20 nearer to the exhaust port 16 and the second scavenging ports 22 nearer to intake port with respect to a horizontal plane of the cylinder bore such that the elevation angle of the second scavenging ports 22 are larger than the elevation angle of the first scavenging ports 20. This structure of the second scavenging ports 22 having a relatively large elevation angle contributes to three-dimensionally scavenging of burnt gas from the combustion chamber.

INDUSTRIAL APPLICABILITY

The present invention is suitable for use as a power source of portable work machine or compact work machine such as a chain saw, brush cutter, hedge trimmer or blower.

What is claimed is:

1. A two-stroke internal combustion engine configured to expel burnt gas externally of a combustion chamber through an exhaust port while introducing air-fuel mixture into the combustion chamber from a crankcase through scavenging passages, first scavenging ports opening to said combustion chamber and oriented away from said exhaust port;

main scavenging passages each having a length from its inlet port opening to said crankcase up to each said first scavenging port and making communication between each said first scavenging port and said crankcase;

second scavenging ports opening to said combustion chamber at positions remoter from said exhaust port than said first scavenging ports respectively, and oriented away from said exhaust port; and a branch scavenging passage branched from each said main scavenging passage and extending aslant away from said exhaust port up to each said second scavenging port, wherein said branch scavenging passage has a cross-sectional area, at all locations within said branch scavenging passage, which is smaller than a cross-sectional area of each said main scavenging passage taken at any position thereof from each said main scavenging passage's inlet port opening to said crankcase up to each said first scavenging port, wherein said branch scavenging passage has a mean cross-sectional area smaller than a mean cross-sectional area of each said main scavenging passages passage, and wherein each said first scavenging port and each said second scavenging port have opening areas which are in total larger than a cross-sectional area of each said main scavenging passage at an inlet portion thereof next to said crankcase.

2. The two-stroke internal combustion engine according to the claim 1, wherein each said branch scavenging passage has a minimum cross-sectional area approximately 0.29 to 0.38 times a minimum cross-sectional area of each said main scavenging passage.

3. The two-stroke internal combustion engine according to claim 2, wherein a sum of cross-sectional areas of each said first scavenging port and each said second scavenging port is approximately 1.2 to 1.4 times the cross-sectional area of each said main scavenging passage at said inlet portion thereof next to said crankcase.

4. The two-stroke internal combustion engine according to claim 2, wherein fresh air is supplied to said main scavenging passages or said branch scavenging passages.

5. The two-stroke internal combustion engine according to claim 2, wherein said main scavenging passages extend vertically upright.

6. The two-stroke internal combustion engine according to claim 5, wherein each branch scavenging passage has an upper wall and a lower wall both extending aslant from said main scavenging passage toward an intake port in parallel to each other.

7. The two-stroke internal combustion engine according to claim 2, wherein each said main scavenging passage inclines away from said exhaust port gradually from said inlet portion thereof next to said crankcase toward said first scavenging port.

8. The two-stroke internal combustion engine according to claim 2, wherein each said second scavenging port has an elevation angle larger than an elevation angle of said first scavenging port.

9. The two-stroke internal combustion engine according to claim 2, wherein the extending direction of each branch scavenging passage is common to the extending direction of each second scavenging port thereof.

10. The two-stroke internal combustion engine according to claim 1, wherein a sum of cross-sectional areas of each said first scavenging port and each said second scavenging port is approximately 1.2 to 1.4 times the cross-sectional area of each said main scavenging passage at said inlet portion thereof next to said crankcase.

11. The two-stroke internal combustion engine according to claim 1, wherein fresh air is supplied to said main scavenging passages or said branch scavenging passages.

12. The two-stroke internal combustion engine according to claim 1, wherein said main scavenging passages extend vertically upright.

13. The two-stroke internal combustion engine according to claim 7, wherein each branch scavenging passage has an upper wall and a lower wall both extending aslant from said main scavenging passage toward an intake port in parallel to each other.

14. The two-stroke internal combustion engine according to claim 1, wherein each said main scavenging passage inclines away from said exhaust port gradually from said inlet portion thereof next to said crankcase toward said first scavenging port.

15. The two-stroke internal combustion engine according to claim 1, wherein each said second scavenging port has an elevation angle larger than an elevation angle of said first scavenging port.

16. The two-stroke internal combustion engine according to claim 1, wherein the extending direction of each branch scavenging passage is common to the extending direction of each second scavenging port thereof.

* * * * *